United States Patent [19]

Volkmann

[11] Patent Number: 4,466,778

[45] Date of Patent: Aug. 21, 1984

[54] EJECTOR DEVICE

[76] Inventor: Jürgen Volkmann, Zum Vulting 10, D-4777 Schwefe, Fed. Rep. of Germany

[21] Appl. No.: 323,375

[22] Filed: Nov. 20, 1981

[30] Foreign Application Priority Data

Jul. 5, 1980 [DE] Fed. Rep. of Germany ..... 3025525

[51] Int. Cl.[3] ..... F04F 5/00

[52] U.S. Cl. ..... 417/174; 417/187

[58] Field of Search ..... 417/169, 174, 151, 163

[56] References Cited

U.S. PATENT DOCUMENTS

| | | | |
|---|---|---|---|
| 2,000,762 | 5/1935 | Kraft | 417/167 |
| 2,211,795 | 8/1940 | Sauer | 417/167 X |
| 2,275,627 | 3/1942 | Hartmann | 417/174 X |
| 2,378,425 | 6/1945 | Murray | 417/174 |
| 3,445,335 | 5/1969 | Gluntz | 417/151 X |
| 3,959,864 | 6/1976 | Tell | 417/174 X |

FOREIGN PATENT DOCUMENTS

WO80/02863 12/1980 PCT Int'l Appl. .

*Primary Examiner*—Edward K. Look

*Attorney, Agent, or Firm*—Larson and Taylor

[57] ABSTRACT

An ejector device which has at least two ejectors formed by a corresponding number of axially aligned nozzles of increasing cross section in the direction of flow. The device is formed as a series of modules, each module having a transverse wall and a section of housing. These housing sections abut each other to form chambers between these transverse walls. The transverse walls contain the aligned nozzles and also openings between the chambers with one way valves permitting fluid flow only in the direction of flow through the nozzles. Various arrangements are provided for connecting the housing sections together. A valve arrangement permits selectively eliminating the vacuum in the first chamber.

12 Claims, 3 Drawing Figures

EJECTOR DEVICE

The invention relates to an ejector device consisting of at least two ejectors within a common elongated housing, said ejectors being formed by a corresponding number of nozzles of increasing size arranged axially in succession, said housing being subdivided into chambers, separated from one another by check valves and by the transverse walls containing the nozzles.

Ejector devices of this type, wherein the nozzles located between the first and last nozzles are simultaneously driving and collecting nozzles, are basically known. However, their practical use thus far has been limited to the production of a vacuum to pump down vessels and the like, whereby all of the chambers, with the exception of the chambers following the last nozzle, are initially connected to the vessel and relatively large quantities of air must be supplied for evacuation, said air quantities being reduced stepwise by successively closing the check valves as the vacuum increases, until the final vacuum is eventually produced only by the ejector consisting of the first two nozzles. Moreover, the construction of such ejector devices entails considerable expense and requires extensive individual adjustment to each specific application.

To simplify and standardize at least the housing of such ejector devices, it is also known (German Offenlegungsschrift No. 24 57 360) to manufacture the ejector housing from a transverse extruded section, said section, depending on its length, offering an ejector housing of different width for any number of parallel sets of successive nozzles, which is subsequently provided with a corresponding number of holes for installing the nozzles. The number of successive chambers and hence the number of successive ejectors is fixed, however, and all chambers communicate via lateral openings with check valves mounted therein with a common vacuum chamber, to which a vessel to be evacuated or other device to be operated under vacuum can be connected.

Hence, the possible applications of the known ejector device with a housing made in the form of an extruded section is limited, despite the optional number of parallel nozzle sets, and the adjustment to each specific application with different numbers and choices of nozzles results in a considerable machining cost which cancels out the advantages of the extruded section.

Hence, the goal of the invention is to provide an ejector device of the type described hereinabove which permits easy adaptation to a wide variety applications, utilizing the economic advantages of mass production but without any particular machining cost, thereby increasing the range of possible applications of the ejector device.

This goal is achieved according to the invention by virtue of the fact that the housing, in a modular design, consists of a plurality of sections which abut one another lengthwise and can be combined with one another as desired, each of said sections having no more than one transverse wall. The invention is based on the fact that the number of successive ejectors differs for different applications and, by using the modular system, offers the possibility of an individualized assembly of modular elements, designed as sections, into an ejector device appropriate for each individual application. The assembly of the sections, which can be combined in any sequence, permits manufacturing the individual sections in large numbers without limiting the number of their possible applications. Manufacturing costs decrease as a result, and the ejector device which is correct for each application can be assembled in minimum time from a limited number of prefabricated sections.

The sections can be assembled in different ways. According to a first feature for advantageous design, the sections are held together by common connecting means such as through tie rods, for example. According to an alternative embodiment, however, special connecting means can be provided for connecting two adjacent sections to each other. In this case it is particularly advantageous for the housings to have a circular cross section and for the sections to be equipped with screw threads. The sections can then be screwed together directly. However, it is also possible, within the framework of another advantageous embodiment of the invention, to tension the sections against one another by using coupling rings. This is especially advantageous when the transverse walls contain a plurality of eccentrically disposed nozzles, said nozzles having to be aligned axially with respect to one another, consequently not permitting direct screwing of the sections together.

Within the framework of the invention, the individual sections can each consist of one transverse wall and one housing wall adjacent thereto. The nozzle spacing is determined in this case, however, by the length of the housing walls. To deal with this limitation without thereby increasing the number of sections equipped with nozzles, a special feature of the invention provides that the transverse walls on the one hand and the housing walls of the chambers on the other form sections which are separate from one another. To accomplish this, it is sufficient simply to make the sections which form the circumferential housing walls of the chambers of different lengths, in order to permit the desired nozzle spacing.

As already mentioned, each transverse wall can contain one nozzle, preferably located at its center, or even a plurality of nozzles distributed in any fashion, provided only that appropriate transverse walls be provided for each nozzle size with an appropriate nozzle distribution. Naturally, it is also possible to provide the transverse walls in individual cases with an appropriate number and distribution of holes, into which the nozzles can be installed later in a suitable fashion. In addition, the nozzles can be formed directly in the transverse walls by suitably shaped holes.

In addition, another advantageous embodiment of the invention provides that the transverse walls contain one or more through openings, equipped with check valves, in addition to having at least one nozzle each, said through openings permitting large quantities of air to be drawn in with the aid of all successive nozzles when vacuum generation begins, and then, as the vacuum increasess, automatically to shut off those chambers whose vacuum is limited by the increasng nozzle size.

Another embodiment of the invention provides for equiping the sections in the vicinity of the housing walls of the chambers with connecting openings into which hose connections, valves, or sealing plugs can be screwed.

According to yet another embodiment of the invention, one section for forming the pressure chamber which follows the last nozzle is made pot-shaped, and provided with one or more end and/or radial blow-out openings. The blow-out openings can be provided with threads for screwing on connecting nipples or sealing plugs, and, finally, the pot-shaped section can also contain an insert for noise suppression.

Aother feature of the invention consists in a transverse wall, containing the first nozzle, having at least one additional opening for connection to a pressure reservoir through a shuttle valve, said reservoir being fillable through the valve from the same pressure source which supplies a pressure medium to the ejector device.

The ejector device according to the invention permits a wide variety of applications and thus offers a plurality of advantages over known ejector devices with a plurality of ejectors.

Thus, the ejector device according to the invention can be used in known fashion for producing a vacuum by means of a propellant gas, for example compressed air, under pressure, whereby the exhausted gas is a multiple of the quantity of propellant gas as a result of the successive connection of a plurality of ejectors. Thus, by comparison with conventional ejectors, consisting only of one driving nozzle and one collecting nozzle, considerable energy savings are achieved, and, by contrast with known ejector devices with a housing made of an extruded section, the number of successive ejectors may be selected freely to suit each individual application.

Furthermore, the ejector device according to the invention permits simultaneous production of pressure and vacuum, as is required for example for mechanical movement of sheets of paper in printing plants. This requirement in the past could be met only with the aid of electric vacuum pumps, which are subject to wear and considerable expense to maintain them and to eliminate wear, which require sealing oil, and which have comparatively large dimensions and have a high noise level. The special arrangement of the additional opening in the transverse wall containing the first nozzle for connecting a pressure reservoir through a shuttle valve in such applications also permits a sudden shutoff of the vacuum and the generation of pressure when the propellant gas is shut off, with the shuttle valve automatically changing its position, connecting the chamber which was previously under vacuum, to which the suction devices of the machine are connected, with the pressure reservoir. The sheets of paper held in place by the vacuum are then instantly released.

The ejector device according to the invention also makes it possible to mix several gases in a simple fashion, whereby a first gas, under pressure, is used as the propellant gas and additional gases are drawn into the intermediate chambers between the individual nozzles, thereby being mixed with each other. In the same way, gases can be mixed with liquids and/or pulverized or granulated solids.

Depending on how many nozzles are provided on each transverse wall, multiple ejector devices with different performance levels can be assembled by using a relatively small number of different individual elements.

Finally, the ejector device according to the invention makes it possible, at minimum energy expenditure, to achieve a multiplication of the volume of gas used as a propellant gas with a corresponding reduction in its pressure. Thus, for example, when five ejectors are connected in sequence, the volume of gas which is expelled is at least eight times the volume of propellant gas which is used to effect the reduction in pressure.

The present invention is described in greater detail below with reference to the accompanying drawings which illustrate perferred embodiments of the invention and wherein.

Referring now to the drawings, like elements are represented by like numerals throughout the several views.

Figure 1:
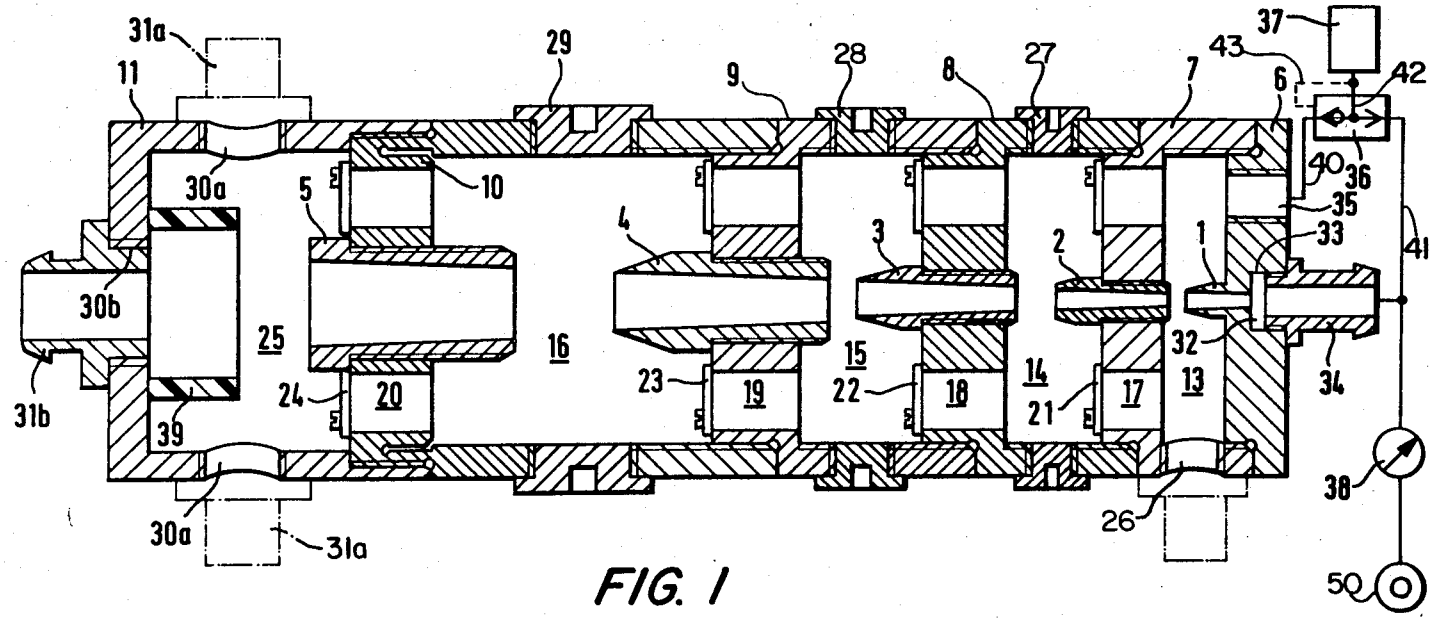
FIG. 1 is a central axial sectional view taken through a multiple-stage ejector device illustrating one embodiment of the present invention.

Referring to FIG. 1, reference numbers 1–5 represent five nozzles whose sizes increase in numerical order, said nozzles, in this example, forming a single nozzle set located on the central axis of the ejector device. Alternatively, a plurality of such nozzle sets with a plurality of nozzles mounted side by side or on a circle, all of the same size, could be provided, whereby the parallel nozzles would once again be aligned axially with respect to one another in sets. Nozzles 1–5 are inserted in recieving holes within transverse walls 6–10 by pressing, gluing, or screwing, or the nozzles can also be a part of these walls.

The connecting design shown in FIG. 1 provides that the transverse walls, such as walls 6–10 in the example, are each mounted integrally with a housing wall, thereby forming a segment associated with the latter, which segment can be screwed directly to the adjacent section with the aid of internal and external threads at facing ends. Since this will not assure alignment of nozzles except on the central axis, this design can be used only in conjunction with central jet nozzles.

Figure 2:
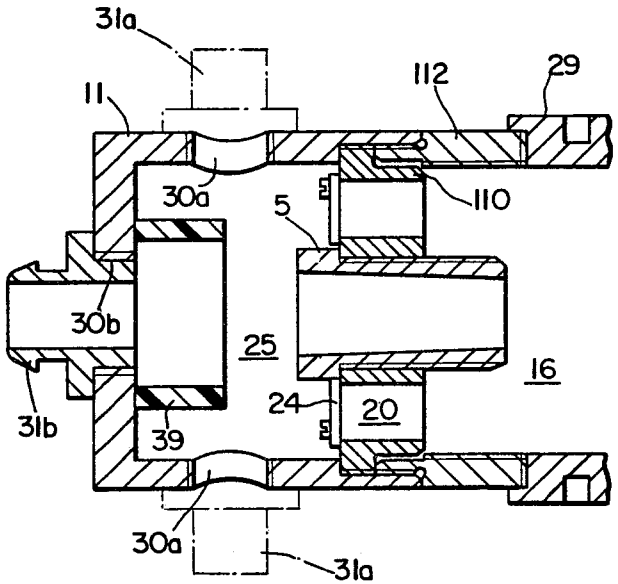
FIG. 2 illustrates a left hand portion of FIG. 1, but showing a modified connecting means.

FIG. 2 shows a modified connecting design which provides that each, some or all of the transverse walls, such as transverse wall 110 illustrated in FIG. 2, forms a section and is received in a recess, delimited by a shoulder, within the section 11 which forms the housing wall of a successive chamber, in which section 11 they are held by a further housing wall section 112 and sealed, said section 112 being provided with external threads and being screwed into successive housing wall section 11, provided with internal threads within the recess. This connecting design is especially suited for the case in which the transverse wall comprises a plurality of eccentric nozzles (not shown), which must be aligned with one another from one transverse wall to the next.

Figure 3:
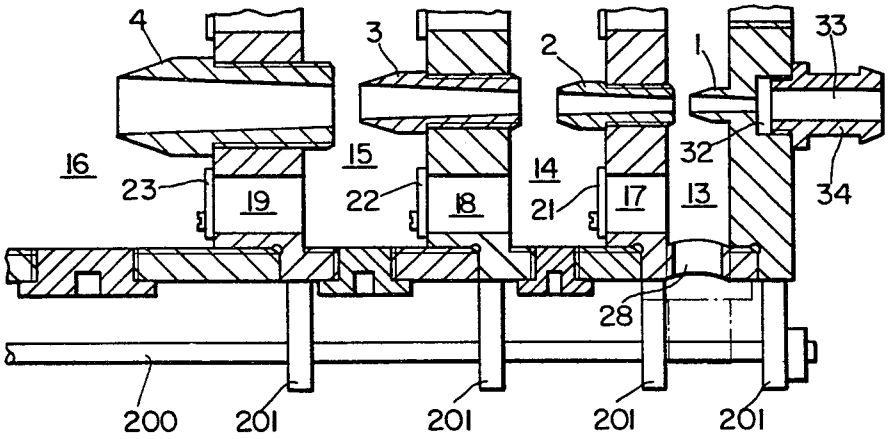
FIG. 3 illustrates a lower right hand section of FIG. 1, showing still another type of connecting means.

FIG. 3 shows still another connecting design wherein a connecting rod 200 connects the adjacent sections together through suitable projections, shown schematically at 201, connected to their respective sections.

Referring again to FIG. 1, and for any of the above described connecting designs, chambers 13–16, resulting from the above-described segmental construction method, are connected by through openings 17–20 in the transverse walls between the individual jet nozzles, said openings having check valves 21–24 which close as soon as the vacuum in a chamber becomes greater than that in the next chamber. The last chamber 25, on the other hand, it under pressure during operation.

Individual chambers 13–16 comprise radial connecting openings 26–29, provided with threads, and permitting the fitting of connecting nipples or sealing plugs, depending on the application. Similarly, segment 11, which seals off the device and is made pot-shaped for the purpose, is provided with radial connecting blow out openings **30*a* and an axial connecting opening 30*b*, into which connecting nipples or sealing plugs 31***a* or 31*b* are insertable.

The first transverse wall 6 contains a pressure distribution chamber 32 upstream of jet nozzle 1 or possibly several such jet nozzles inserted therein, to which chamber a connecting nipple 34, inserted in a hole 33, leads to a supply source 50 for the propellant gas to the ejector device. A regulator 38 in the propellant gas supply line permits continuous adjustment of propellant gas pressure and volume.

The chamber 13 located between the first and second jet nozzles 1 and 2 is also connected by a connecting opening 35 in transverse wall 6 and line 40 with one connection of a shuttle valve 36, another connection of which is connected via line 41 to the propellant gas supply line which leads to the connecting nipples 34. A third connection of valve 36 leads via line 42 to a pressure reservoir 37. Further, the shuttle of shuttle valve 36 may be preloaded toward the right by pressure in reservoir 37 via line 43. This arrangement permits the vacuum in chamber 13 to be pressurized immediately when the supply of propellant gas to nozzle 1 is shut off. When shutting off the supply of pressure from source 50 the pressure in line 41 also drops and this allows the preloading pressure via line 43 to move the shuttle valve 36 to the right, at which position the pressure reservoir 37 communicates via lines 42, valve 36 and line 40 to opening 35 and chamber 13. When the supply pressure from source 50 is again supplied to the nipple 34 (or is initially applied) this pressure in line 41 moves the shuttle valve 36 to its left position thereby blocking line 40 and permitting the pressurized fluid in line 41 to communicate via line 42 with the reservoir 37 to fill the same. Meanwhile, the shuttle 36 will also be held in its left position by the vacuum in chamber 13.

A suction device connected to connecting opening 26 of chamber 13, used for example to transport sheets of paper, will therefore, upon movement of shuttle valve 36 to the right, immediately release the sheets it has attracted by suction, whereby the resultant pressure prevents the sheet from remaining adhered to the suction device by pure adhesion.

As indicated schematically, a noise suppressor 39, projecting into the last chamber 25, can be provided in segment 11.

Although the invention has been described in considerable detail with respect to preferred embodiments thereof, it will be apparent that the invention is capable of numerous modifications and variations, apparent to those skilled in the art, without departing from the spirit and scope of the invention.

I claim:

1. An ejector device having at least three ejectors formed by a corresponding number of axially aligned, successive nozzles of increasing cross-section in the direction of flow, said device comprising:

an outer, elongated housing, a plurality of spaced apart transverse walls extending across the housing to sub-divide it into at least three chambers, each transverse wall containing at least one of said nozzles, a one way valve in each transverse wall other than the first transverse wall permitting fluid flow only in the same direction of flow as through the nozzles, at least one of said chambers including a connecting opening passing radially through said housing, said device being formed of modules, each module containing one of said transverse walls and an axially extending section of the housing which abuts and connects with adjacent housing sections to form the said housing, said housing sections all being of uniform exterior circumferential size and shape with each other to be interchangable, such that the ejector device is constructed by the assembly of any number of said interchangable modules having selected axial lengths and nozzle constructions.

2. An ejector device according to claim 1, including a common connecting means for connecting together all of said housing sections.

3. An ejector device according to claim 1, wherein the adjacent housing sections are of circular cross-section and include screw threads for screw threading said adjacent housing sections directly together.

4. An ejector device according to claim 1, wherein within each module, the transverse wall and its respective housing section are separate elements connected together.

5. An ejector device according to any one of claims 1–4, wherein the housing sections are of different axial lengths, the length of each section corresponding to the desired spacing between its nozzle and the nozzles of adjacent modules.

6. An ejector device according to any one of claims 1–4, wherein at least some of said chambers include connecting openings passing through said housing sections in a radial direction.

7. An ejector device according to claim 6, wherein said connecting openings include means for connecting the same to suction devices attached thereto.

8. An ejector device according to any one of claims 1–4, including at the downstream end of the device, past the last nozzle, a pot-shaped member forming a pressure chamber and provided with at least one blow-out opening.

9. An ejector device according to claim 8, wherein said blow-out openings include connecting means for connecting nipples or sealing plugs thereto.

10. An ejector device according to claim 8, including a noise suppression means within the pot-shaped member.

11. An ejector device according to any one of claims 1–4, including a valve means operatively connected to the inlet side of the first nozzle and also separately to the first chamber, a pressure reservoir connected to said valve, and means for connecting a pressurized supply fluid to the first nozzle, said valve being operable, upon cutting off of pressurized supply fluid to the first nozzle, to connect the first chamber via the valve with the said pressure reservoir.

12. An ejector device having at least two ejectors formed by a corresponding number of axially aligned, successive nozzles of increasing cross-section in the direction of flow, said device comprising:

an outer, elongated housing, a plurality of spaced apart transverse walls extending across the housing to sub-divide it into chambers, each transverse wall containing at least one of said nozzles, a one-way valve in each transverse wall permitting fluid flow only in the same direction of flow as through the nozzles said device being formed of modules, each module containing one of said transverse walls and an axially extending section of the housing which abuts and connects with adjacent housing sections to form the said housing, and including a valve means operatively connected to the inlet side of the first nozzle and also separately to the first chamber, a pressure reservoir connected to said valve, and means for connecting a pressurized supply fluid to the first nozzle, said valve being operable, upon cutting off of pressurized supply fluid to the first nozzle, to connect the first chamber via the valve with the said pressure reservoir.

* * * * *